US010780363B2

(12) United States Patent
Van der Westhuizen

(10) Patent No.: US 10,780,363 B2
(45) Date of Patent: Sep. 22, 2020

(54) KITE LINE REELING DEVICE

(71) Applicant: Johannes Petrus Van der Westhuizen, Calgary (CA)

(72) Inventor: Johannes Petrus Van der Westhuizen, Calgary (CA)

( * ) Notice: Subject to any disclaimer, the term of this patent is extended or adjusted under 35 U.S.C. 154(b) by 582 days.

(21) Appl. No.: 15/128,867

(22) PCT Filed: Mar. 25, 2015

(86) PCT No.: PCT/IB2015/052181
§ 371 (c)(1),
(2) Date: Sep. 23, 2016

(87) PCT Pub. No.: WO2015/145363
PCT Pub. Date: Oct. 1, 2015

(65) Prior Publication Data

US 2017/0106306 A1 Apr. 20, 2017

(30) Foreign Application Priority Data

Mar. 25, 2014 (ZA) ..... 2014/02191

(51) Int. Cl.
*B63H 8/16* (2020.01)
*A63H 27/08* (2020.01)
(Continued)

(52) U.S. Cl.
CPC ..... *A63H 27/082* (2013.01); *B63H 8/16* (2020.02); *B65H 75/406* (2013.01);
(Continued)

(58) Field of Classification Search
CPC ..... A63H 27/082; B65H 75/4428; B65H 75/4452; B65H 75/406; B65H 2701/356; B63B 35/7979
See application file for complete search history.

(56) References Cited

U.S. PATENT DOCUMENTS 2,726,828 A 12/1955 Pashkow
4,129,273 A 12/1978 Hill
(Continued)

FOREIGN PATENT DOCUMENTS

GB 458018 A * 12/1936 ..... B65H 75/38

OTHER PUBLICATIONS

Jul. 9, 2015—(WO) International Search Report and Written Opinion—APP PCT/IB2015/052181.
Feb. 26, 2016—(WO) IPRP—APP PCT/IB2015/052181.

*Primary Examiner* — Brian M O'Hara
*Assistant Examiner* — Keith L Dixon
(74) *Attorney, Agent, or Firm* — Baner & Witcoff, Ltd.

(57) ABSTRACT

This invention concerns a line reeling device for reeling front and back lines of a kite. The device includes a reeling mechanism comprising a first reel and a second reel which are located in an enclosure and on which the front and back lines are, in use, wound respectively. The reels are arranged so that their rotation in one direction retracts the lines and their rotation in the other direction deploys the lines. The reeling mechanism further includes reel connecting means which is operable to cause the reels to rotate in harmony in one configuration and rotate independently in another configuration. The reeling mechanism also has a braking mechanism for controlling rotation of the reels and a control mechanism which is in connection with the braking mechanism. The control mechanism is operable between a first, locked position wherein rotation of the reels is obstructed and a second, released position wherein rotation of the reels is allowed.

15 Claims, 11 Drawing Sheets

(51) Int. Cl.
*B65H 75/40* (2006.01)
*B65H 75/44* (2006.01)

(52) U.S. Cl.
CPC ..... *B65H 75/4428* (2013.01); *B65H 75/4452* (2013.01); *B65H 2701/356* (2013.01)

(56) References Cited

U.S. PATENT DOCUMENTS

| | | | | |
|---|---|---|---|---|
| 6,260,803 | B1 * | 7/2001 | Hunts | B63B 35/7979 242/389 |
| 6,336,607 | B1 | 1/2002 | Perrier | |
| 7,290,731 | B1 * | 11/2007 | Tabor | A63H 27/002 242/291 |
| 2009/0178627 | A1 * | 7/2009 | Bentz | A01K 27/004 119/796 |
| 2009/0189005 | A1 * | 7/2009 | Roman | B65H 75/4428 242/381 |
| 2018/0072533 | A1 * | 3/2018 | Park | H02G 11/02 |

* cited by examiner

KITE LINE REELING DEVICE

CROSS-REFERENCE TO RELATED APPLICATIONS

The present application is a U.S. National Phase of International Application No. PCT/IB2015/052181, filed Mar. 25, 2015, designating the United States of America and claiming priority to South African Patent Application No. 2014/02191 filed Mar. 25, 2014. This application claims the benefit of the above-identified application which is incorporated by reference herein in its entirety.

BACKGROUND TO THE INVENTION

This invention relates to a kite line reeling device. In particular, but not exclusively, this invention relates to a handlebar including a device for use in launching and landing kites used in kite surfing, for example.

Modern kite surfing kites are controlled by four lines which, in use, run from the kite down towards the user. Two lines run from the front or leading edge of the kite and are therefore referred to as the front lines while the other two lines run from the back or tailing edge of the kite and are therefore referred to as the back lines. In use, the two front lines are connected to a harness worn by the user while the two back lines are connected to a bar which is gripped by the user. In order to power-up and depower the kite, the user must move the bar closer or further away from him/her respectively. By moving the bar closer the back of the kite is pulled towards the user so as to increase the surface area of the kite relative to the wind. It follows naturally that by moving the bar away from the user the back of the kite moves towards a position more in line with the wind direction so as to decrease the surface area of the kite relative to the wind. It must be understood that the kite is powered and depowered by tightening and loosening the back lines relative to the front lines through the movement of the bar.

In view of what is said above it is important that the lines are correctly connected to the kite when setting up the kite before launching it into the wind. To ensure that the lines are correctly connected to the kite the bar is usually put down on the ground and the lines are laid out. In this position the user normally walks the lines out to ensure that they are not entangled before connecting the individual lines to their respective connecting positions on the kite.

The step of walking out the lines prior to connecting them to the kite not only takes up times but also requires significant space as the lines are typically between 20 m and 30 m in length. Another problem with the current method of setting up the kite is that it must be performed on land. The kite is launched in with the lines stretched out and the user in a position transverse to the direction of the wind, typically around 90°. Users who would like to launch off watercrafts, for example, are often faced with problems in launching the kites as there is usually very limited space for setting up their kites.

At the end of a kite surfing session the kite must be landed. This is typically done by bringing the kite down towards the ground at a position wherein it is substantially perpendicular to the direction of the wind. The kite is then placed on the ground either by a bystander or by the user if he/she has the necessary skills to do so remotely from his/her position. In the process of landing the kite, the lines are fully stretched out, which again requires significant space. Now with the kite on the ground and out of the wind the user normally disconnects the lines from the kite and places them on the ground. The lines are then wrapped around the bar for easy transportation and in an attempt to prevent them from getting tangled up.

From the above description of the process of landing the kite it should be clear that the same problems are experienced during the landing of the kite that are experienced during the launching thereof.

It is an object of this invention to alleviate at least some of the problems experienced during the launching and landing of a kite.

It is a further object of this invention to provide a device for use in landing and launching a kite that will be a useful alternative to existing equipment.

It is a further object of this invention to provide a device for the automatic reeling of kite lines.

SUMMARY OF THE INVENTION

In accordance with a first aspect of the invention there is provided a line reeling device for reeling front and back lines of a kite, the device including a reeling mechanism comprising a first reel and a second reel which are located in an enclosure and on which the front and back lines are, in use, wound respectively, the reels being arranged so that their rotation in one direction retracts the lines and their rotation in the other direction deploys the lines, reel connecting means which is operable to cause the reels to rotate in harmony in one configuration and rotate independently in another configuration, a braking mechanism for controlling rotation of the reels and a control mechanism which is in connection with the braking mechanism and operable between a first, locked position wherein rotation of the reels is obstructed and a second, released position wherein rotation of the reels is allowed.

The reeling mechanism may include a movable cam slider and a cam follower which runs on the cam slider and is moveable substantially perpendicularly to the cam slider in response to movement of the cam slider, and wherein the cam slider is connected to the control mechanism such that it is moveable through manipulation of the control mechanism between its locked and released positions.

The braking mechanism preferably includes a brake drum and brake shoe carried by the cam slider so that the brake shoe is movable towards and away from the brake drum through movement of the control mechanism between its locked and released positions respectively, thereby allowing the magnitude of braking force to be adjusted by moving the control mechanism.

The reeling mechanism may include movement obstructing means for obstructing rotation of at least the second reel in a direction in which the back lines are deployed from the reel, the movement obstructing means being operable between its movement obstructing position and its movement allowing position through manipulation of the control mechanism.

The movement obstructing means is preferably in the form a ratchet and ratchet pawl, the ratchet pawl being moveable between its movement obstructing position wherein it engages the ratchet and its movement allowing position wherein it is disengaged from the ratchet through movement of the cam slider. The ratchet may be carried by the brake drum.

The reel connecting means may be in the form of a gear train which is engaged to allow the first and second reels to rotate in harmony by moving the control mechanism into its second, released position and which is disengaged by moving the control mechanism into its first, locked position.

The gear train preferably has a first primary gear and a second primary gear which are mounted coaxially, the first reel being mounted on a shaft carried by the first primary gear and the second reel being mounted on a shaft carried by the second primary gear.

The first and second reels may be spaced apart from one another and the first and second primary gears are mounted between the reels in such a manner that the gears define a passage to allow a rope to pass therethrough so as to connect the front lines to a harness worn by the user, in use.

The reeling mechanism may further include a dog plate which is movable in response to movement of the cam follower to connect the first primary gear to the first reel in order to engage the gear train and disconnect the first primary gear from the first reel in order to disengage the gear train.

The reeling mechanism may also include a retraction system acting on the first reel, the retraction system preventing rotation of the first reel in a first configuration and allowing rotation of the first reel in a second configuration while the braking mechanism acts on the second reel to control rotation of the second reel.

The retraction system preferably has a spring biased gear which is movable between a first position wherein it engages the first reef to prevent rotation of the first reel and a second position wherein it is disengaged from the first reel to allow rotation of the first reel. The spring biased gear may be mounted on the cam follower so that it is movable between its first and second positions through manipulation of the control mechanism between its locked and released positions such that the spring biased gear is in its second position in which rotation of the first reel is allowed when the control mechanism is in its released position.

The spring biased gear is preferably movable between its first and second positions manually and independently from movement of the control mechanism.

The reeling device may further include two handle bars which are movablely connected to the enclosure such that they are movable between a first, operative position wherein the handle bars extend from the enclosure in substantially opposite directions and a second, inoperative position wherein the handle bars run substantially parallel to one another.

The reeling device may also include a line locking mechanism which is releasably securable to the front lines of the kite so as to allow a force to be transmitted from the front lines to the harness worn by the user, in use.

The gears of the gear train may include two sets of gears, each set having two gears which are coaxially spaced apart.

One pair of gears may be a primary set of gears which is coaxial with the two reels, while the other set of gears may be a secondary set of gears which is perpendicular to the primary set of gears and which, in use, transmit torque between the two primary gears.

The brake drum may be mountable on the shaft of one of the primary gears.

The control mechanism may comprise a handle which is connected to the cam slider so that movement of the handle causes the cam slider to move between its different positions.

The cam follower may be in the form of a bridge which has two legs extending from a central portion which is mountable about the shaft of one of the primary gears, preferably the first primary gear, such that the legs of the cam follower bridge are located on diametrically opposite sides of the first reel when the cam follower bridge is mounted on the shaft.

The cam follower bridge is preferably movable, in a direction substantially parallel to the axial centreline of the primary gears, between a first position in which the gear train is disengaged to allow the reels to rotate independently from one another and a second position in which the gear train is engaged to allow the reels to rotate in harmony with one another.

The dog plate may be mountable on the shaft of the first primary gear, wherein the dog plate is carried by the cam follower bridge so as to connect the shaft and the first reel to engage the gear train when the cam follower bridge is in its second position and disconnect the dog plate and first reel to disengage the gear train when the cam follower bridge is in its first position.

The dog plate and first reel preferably carry complementary shaped engagement means which allows torque to be transmitted from the shaft to the first reel when the gear train is engaged.

The spring actuator gear may be is engageable with a gear formation carried on the top reel. Preferably, the spring actuator gear is mounted on the cam follower bridge so that it is movable substantially linearly in a direction parallel to the axial centreline of the primary gears.

The spring actuator gear may be biased towards its position in which it engages the top reel.

The reeling mechanism may have a button which is accessible from the outside of the enclosure and which disengages the spring retractor gear from the top reel when depressed.

The handle bars are preferably locked in their operative positions by means of releasable pins. The pins may be movable between their locked positions and release positions against spring bias.

In the preferred embodiment of the invention the pins retract completely into recesses in the enclosure when they are in their locked positions in which they lock the handle bars in the operative position.

The device may include a key which carries an engagement formation for engaging the releasable pins when moving the pins to collapse the handle bars.

The line locking mechanism is preferably in the form of a clamp which has a clamp body and a top clamp which is movable between open and closed positions.

Preferably, the line locking mechanism has a clamp lever for operating the line locking mechanism between its open and closed positons, the clamp lever being connected pivotally to the clamp body and by means of a linkage to the movable top clamp such that the linkage holds the top clamp in its closed position when the lever is in its closed position.

In one embodiment of the invention the line locking mechanism has gripping formations which engage the kite lines when the line locking mechanism is connected to the kite lines.

The gripping formation may be in the form of at least one tooth which, in use, introduces a kink in the kite lines so as to increase the gripping force being exerted on the kite lines.

The line locking mechanism is preferably substantially spherical when in its closed position.

In accordance with a third aspect of the invention there is provided a method of operating a kite using a line reeling device including a reeling mechanism having first and second reels which are located in a housing and on which the front and back lines are, in use, wound respectively, the method including the following steps:

connecting the kite to the front and back lines which are wound on the reels;

engaging reel connecting means to cause the two reels to move in harmony;

releasing a braking mechanism to allow the reels to rotate and thereby deploy line from the reels;

braking the reels by applying the braking mechanism;

disengaging the reel connecting means to allow the reels to rotate independently from one another; and locking the reels to prevent them from rotating in a direction deploying line, in use, while flying the kite.

The method may include the step of connecting a line locking mechanism on the front lines to engage a connector carried on the front lines, thereby to transfer tension from the front lines to a harness warn by the user. The method may include deforming the kite lines when connecting the line locking mechanism to them so as to increase the gripping force being exerted on the lines.

The reel connecting means is preferably in the form of a gear train such that the step of engaging the reel connecting means includes compacting the gear train.

The compaction of the gear train may be controlled by a cam slider and cam follower running on a cam profile of the cam slider. The cam slider may be moved by operating a handle which is connected to the cam slider.

The gear train may be compacted in an axial direction in order to connect the top reel with a dog plate carried on a shaft of the primary gear on which the first reel is carried.

The cam follower may be in the form of a bridge and may be moved under spring bias into a position in which it forces the dog plate to engage the first reel when as it is moved along the cam profile. The cam follower bridge is preferably moved along the cam profile by moving the cam slider.

The method preferably includes the step of controlling the rate at which the lines are being deployed by adjusting the braking force being applied by the braking mechanism.

The method may further include monitoring indicating means on the front lines and adjusting the rate at which the lines are being deployed based on the indicators.

The step of releasing a braking mechanism may include moving a brake shoe away from a brake drum. The brake shoe may be moved away from the brake drum by moving the cam slider.

The step of preventing the reels from rotating in a direction deploying line includes preventing them independently from rotating in a direction deploying line.

The first reel is preferably prevented from rotating in a direction deploying line by engaging it with a spring biased gear and the second reel is preferably obstructed from rotating in a direction employing line by engaging a ratchet pawl with a ratchet.

The ratchet pawl may automatically disengage the ratchet when the reel connecting means is engaged.

The method may further include the step of taking up slack in the front lines by rotating the spring biased gear under action of a torsion spring when engaging the first reel.

The method may also include the step of adjusting the length of the front lines so that the front and back lines are of equal length. This step is preferably carried out prior to releasing the braking mechanism. This step may also include disengaging the spring biased gear from the first reel.

The method may also include the step of retrieving the kite lines by engaging a hand operated tool with the line reeling device and activating the tool to rotate the reels in a direction opposite to the direction in which they rotate to deploy line. The hand operated tool may be engaged with the line reeling device using a removable adaptor. The method may include engaging the reel connecting means by compacting it manually through downward movement of the hand operated tool.

The method may also include moving handle bars protruding from the line reeling device between operative and inoperative positions. The method preferably includes holding the kite between the handle bars when they are in their inoperative positions so as to facilitate transport of the kite when not in use in its folded state.

BRIEF DESCRIPTION OF THE DRAWINGS

The invention will now be described in more detail, by way of example only, with reference to the accompanying drawings in which.

DESCRIPTION OF THE ILLUSTRATED EMBODIMENT

Figure 1:
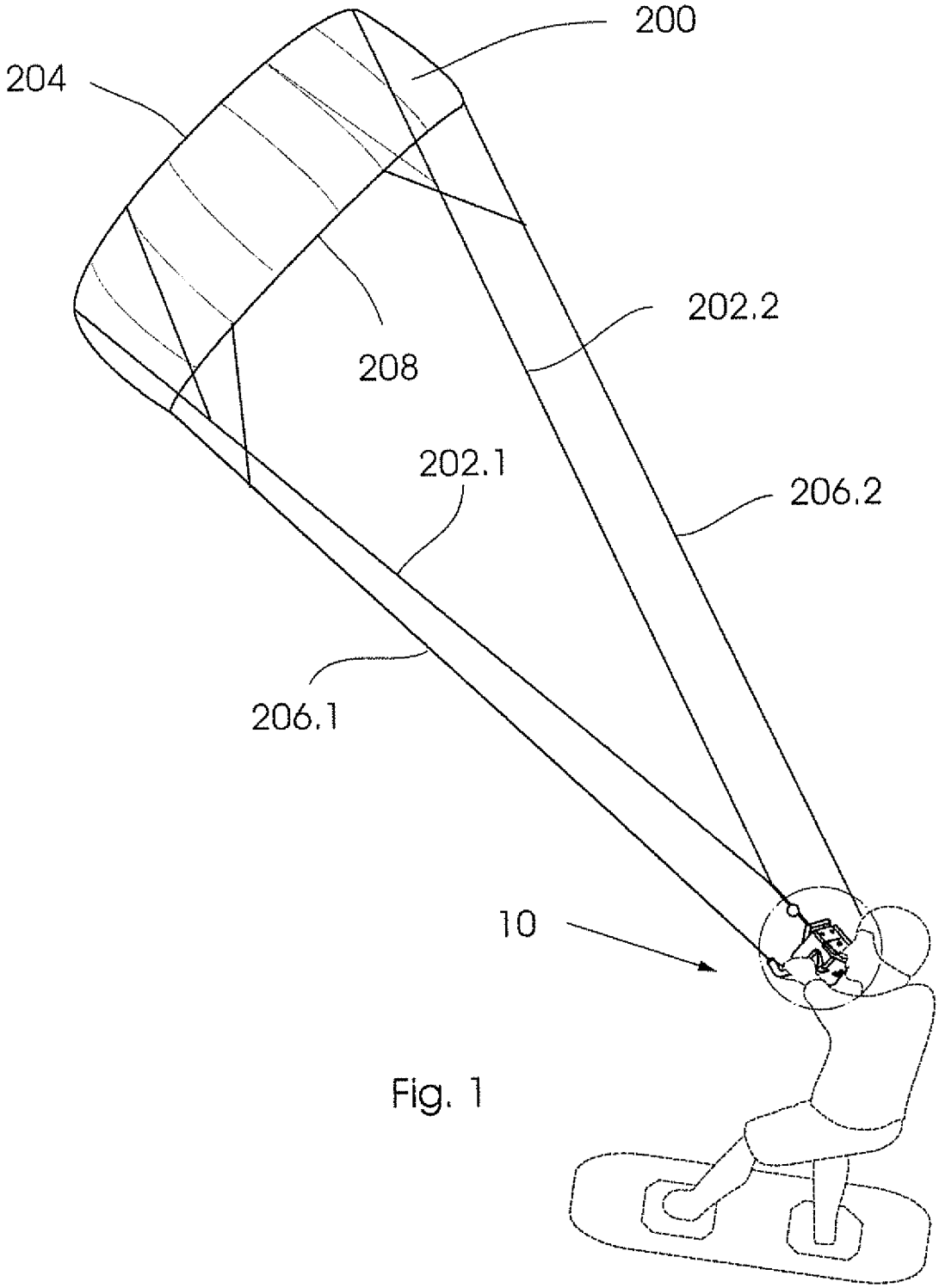
FIG. 1 shows a perspective view of a kite line reeling device in accordance with the invention, in use.

Referring to the drawings, in which like numerals indicate like features, a non-limiting example of a kite line reeling device in accordance with the invention is generally indicated by reference numeral 10.

Figure 2:
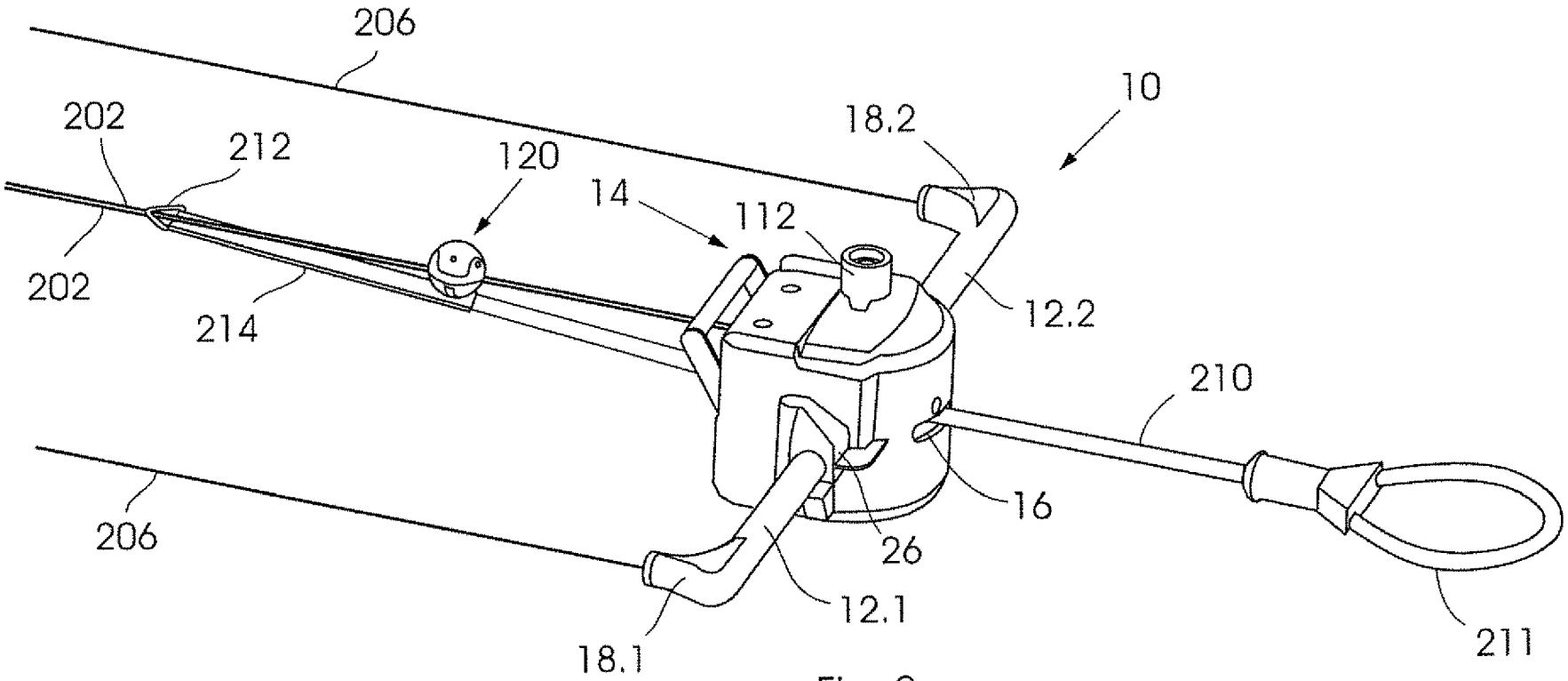
FIG. 2 shows an enlarged view of the device of FIG. 1.

A perspective view of the kite line reeling device 10 in use is shown in FIG. 1 while FIG. 2 shows an enlarged perspective view of the device. The device 10 has two handle bars 12.1 and 12.2 which extend in substantially opposite directions to form a handlebar of a kite 200, such as a kite used in the sport of kite surfing, for example. It can be seen that the kite 200 is controlled by four lines running from the kite to the handlebar. The first set of lines, which includes two individual lines indicated by the reference signs 202.1 and 202.2, runs from the front or leading edge 204 of the kite 200. The lines 202.1 and 202.2 will hereinafter be referred to collectively as the front lines 202. A second set of lines, which includes two individual lines 206.1 and 206.2, runs from a back or trailing edge 208 of the kite 200 to the two laterally opposed sides of the handlebar. The lines 206.1 and 206.2 will hereinafter be referred to collectively as the back lines 206.

In use, the front lines 202 are connected to a rope 210 which is, in turn, connected to a harness (not shown in the accompanying drawings) worn by the user using a chicken loop 211. The front lines are connected to the rope 210 by means of a connector 212, also referred to as a D-link as shackle, carried on the end of a strap 214, which is provided at the end of the rope 210. As shown in FIG. 2, the front lines 202 run through the connector 212 so that the connector can move freely along the length of the front lines. In order to allow a force to be transferred from the front lines 202 to the rope 210 and ultimately the harness worn by the user, a line locking mechanism 120 is secured onto the front lines. In use, the line locking mechanism 120 is fixed into position on the front lines 202 and acts as a limit stop to limit the movement of the connector 212 along the front lines. In use, after the desired length of the lines has been deployed, the line locking mechanism 120 is fixed onto the front lines 202 in a position between the device 10 and the connector 212. The line locking mechanism 120 now secures the two front lines and acts as an anchor point for the connector 212. In view of the fact that the rope 210 is attached to the user's harness the connector 212 will slide back towards the device 10 until it comes into contact with the line locking mechanism 120. The locking mechanism 120 prevents further movement of the connector 212 towards the device 10 and accordingly allows the tension in the front lines 202 to be transferred to the connector 212 and ultimately to the user's harness through the rope 210. A person skilled in the art of kitesurfing would appreciate that the line locking mechanism 120 allows the kite's power and depower straps to function normally without requiring any adjustment.

The kite reeling device 10 has a reeling mechanism 14 located in the centre of the handlebar. The rope 210 runs through a passage 16 in the reeling mechanism 14 so as to allow the handlebar to move relative to the rope 210 when powering and depowering the kite 200. The back lines 206 run from the trailing edge 208 of the kite 200 towards the end regions 18.1 and 18.2 of the handle bars 12.1 and 12.2 respectively from where they run towards the central reeling mechanism 14. The back lines 206 run in conduits 19 along in the handle bars 12.1 and 12.2 and exit the handle bars in their end regions 18.1 and 18.2 respectively. It must be understood that in order to power and depower the kite the connection point between the front lines 202 and the rope 210 must remain stationary in relation to the connection points between the back lines 206 and the line reeling device 10 whenever moving the handle bar relative to the rope. This relative movement between the front and back lines allows the kite 200 to change the size of its surface area in the wind. In other words, the relative movement between the connections points of the front lines in relation to the connection points of the back lines allows the user to change the angle of attack of the kite in the wind.

Figure 5:
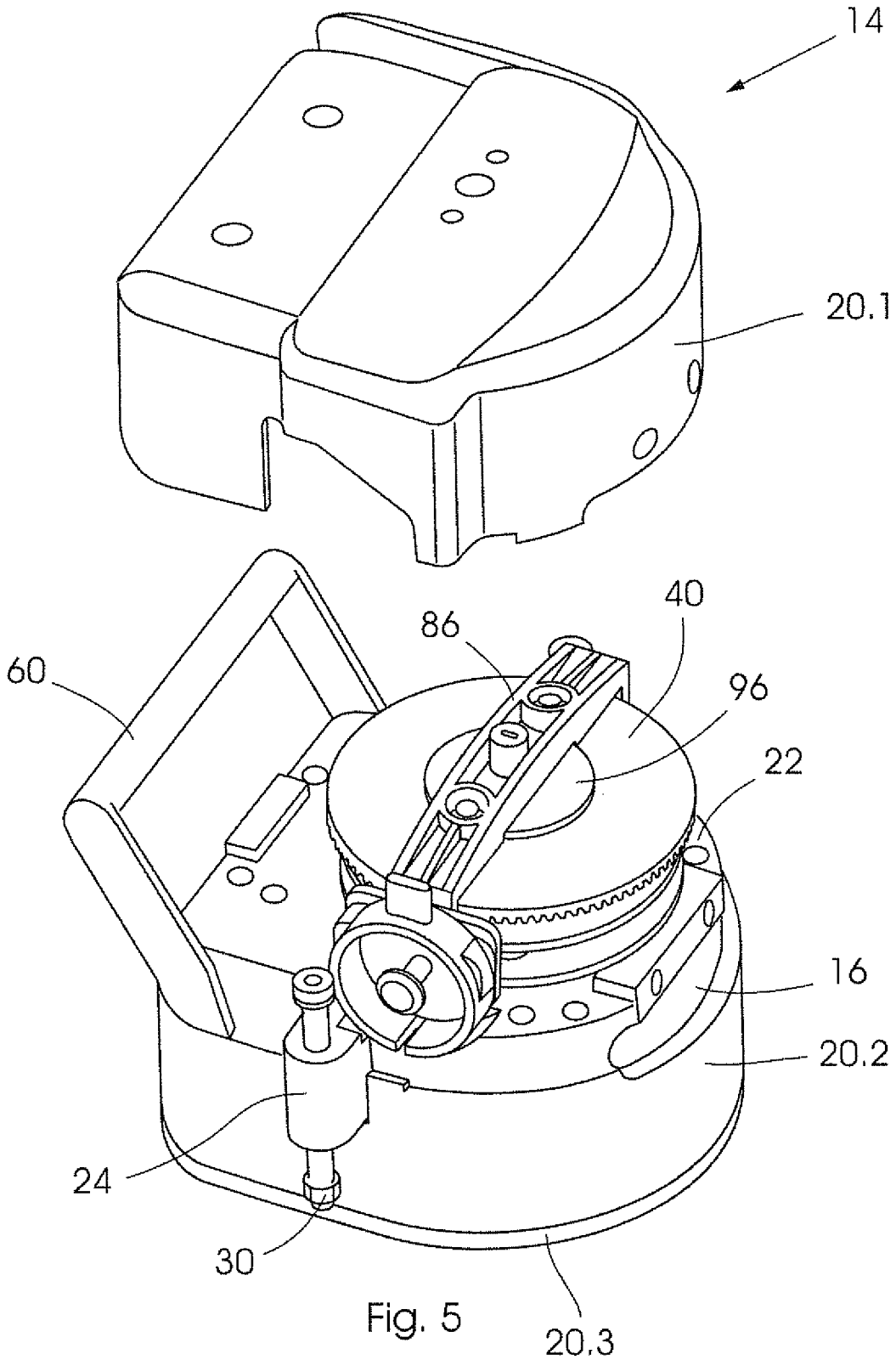
FIG. 5 shows an exploded, top perspective view of the device of FIG. 1.
Figure 6:
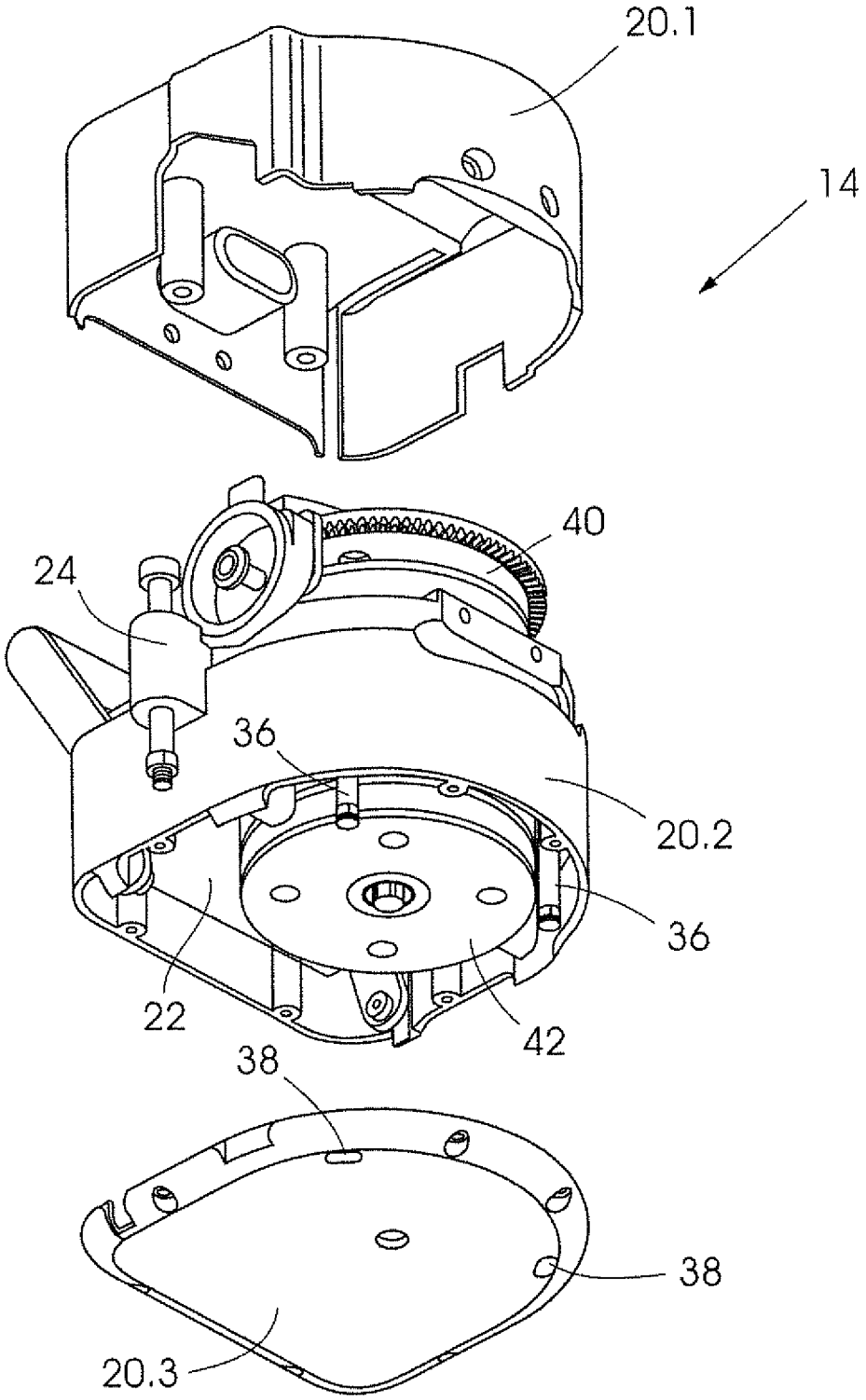
FIG. 6 shows an exploded, bottom perspective view of the device of FIG. 1.

The reeling mechanism 14 has a housing or enclosure which includes a top enclosure 20.1, a bottom enclosure 20.2 and a bottom enclosure cover 20.3. The enclosure is held together by securing the individual components to a body or main support block 22 (FIGS. 5 and 6). In the preferred embodiment of the reeling device 10, the top and bottom enclosures 20.1 and 20.2 are secured to the support block 22 by means of fasteners, such as screws for example. The bottom enclosure cover 20.3 is secured to the bottom enclosure 20.2 also by means of fasteners such as screws.

Figure 3:
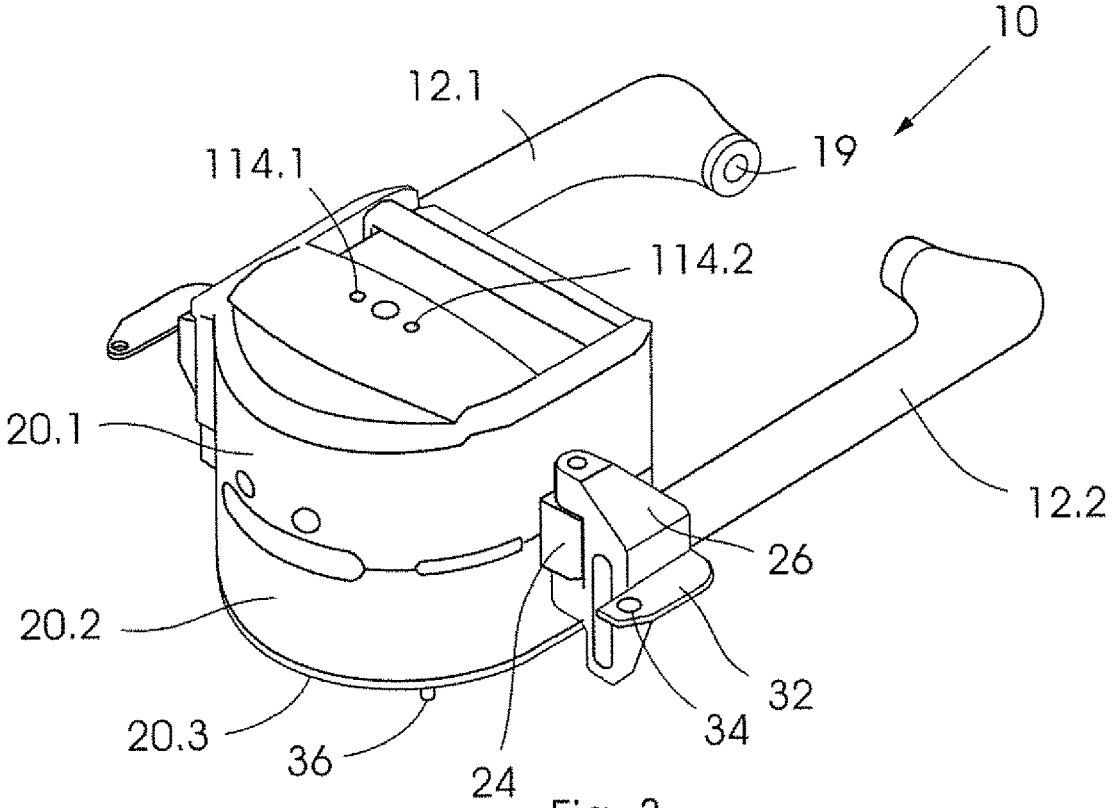
FIG. 3 shows a perspective view of the device of FIG. 1 in which its handle bars are shown in their inoperative, collapsed positions.

The support block 22 carries two connecting portions 24 which protrude therefrom and extend through openings in the enclosure. The connecting portions 24 connect to complementary shaped connecting portions 26 (FIGS. 2 and 3) carried on the ends of the handle bars 12.1 and 12.2. The connecting portions 24 and 26 are secured to one another by a fastener 28 which extends through aligned holes in the connecting portions when the handle bars are connected to the support block 22. From FIG. 4 it can be seen that the fastener 28 is in the form of a threaded bolt and is secured in the aligned holes of the connecting portions 24 and 26 by a nut 30. The bolt 28 creates a pivot axis about which the handle bars are capable of pivoting so that they are movable between a first operative position (FIG. 2) wherein they extend in substantially opposite directions away from the reeling device 14 and an inoperative position wherein they are collapsed so that they are substantially parallel to one another (FIG. 3). From FIG. 3 it can be seen that each handle bar 12.1, 12.2 has a locking tab 32 which extends from its connecting formation 26 and carries a hole 34. In use, the handle bars are locked in their operative positions by means of locking pins 36. Each locking pin 36 is independently movable between a first, locked position wherein it extends through the hole 34 in the corresponding locking tab 32 in order to obstruct movement of the associated handle bar and a second, released position wherein the locking pin is removed from the hole 34 in order to allow movement of the handle bar. In the preferred embodiment of the device 10 the locking pins 36 are biased under spring bias into their first, locked positions so that the handle bars 12.1 and 12.2 are in a normally locked state, in use. As a safety feature the locking pins 36 (FIG. 6) retract fully into sockets 38 (FIG. 6) provided in the enclosure thereby to prevent them from being moved accidentally into their released positions. It should be understood that no part of the locking pins 36 protrude from the enclosure when they are in their locked positions. In order to move the locking pins 36 from their locked positions and into their released positions they carry engaging formations which can be gripped by a gripping tool 144. In the illustrated embodiment of the invention the gripping formations are in the form of annular grooves and the gripping tool carries a fork-shaped end 146 which is receivable in the grooves. It is envisaged that the gripping tool could either be stored in a space in the enclosure or in a space in the line locking mechanism 120 as shown in the accompanying drawings. In the illustrated embodiment of the device 10 the gripping tool in stored inside the line locking mechanism 120. More about this is said below.

Figure 7:
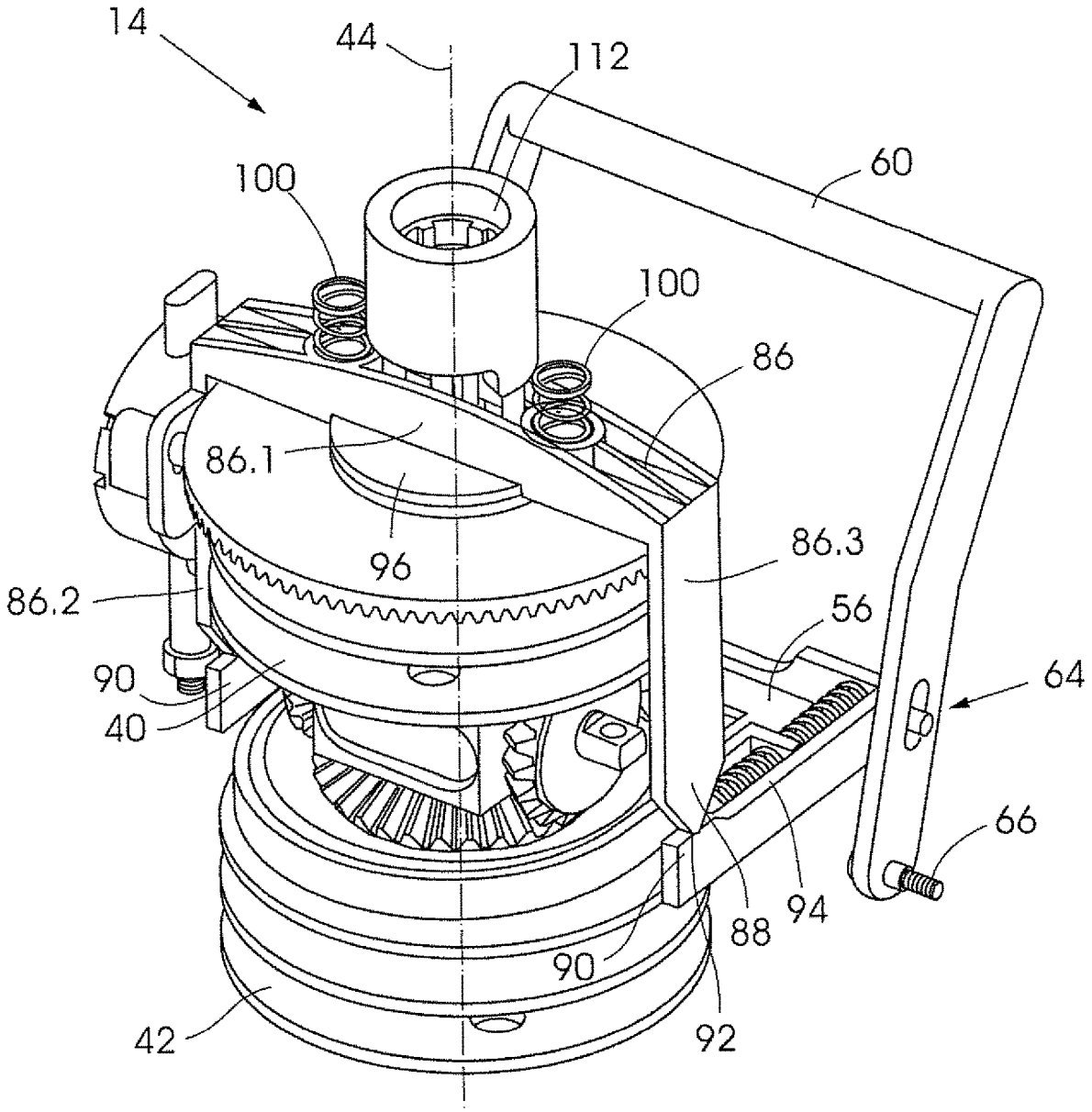
FIG. 7 shows a perspective view of the device of FIG. 1 in which its enclosure has been removed to reveal a line reeling mechanism of the device.
Figure 8:
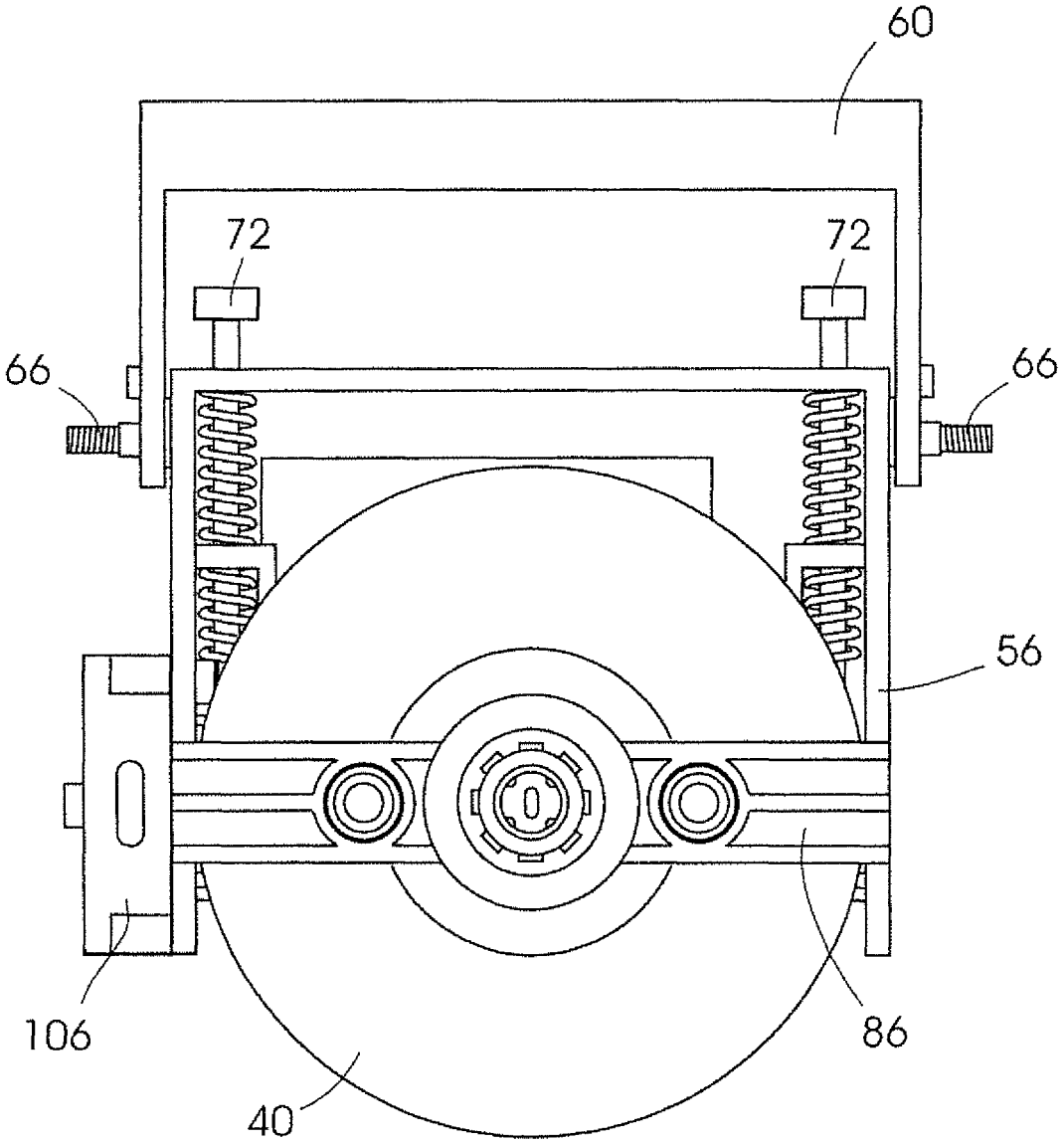
FIG. 8 shows a top view of the device of FIG. 1 in which the enclosure has been removed.

In FIG. 7 the enclosure and central mounting block 22 of the device 10 are removed to reveal the components of the reeling mechanism 14. The reeling mechanism 14 includes a first or top reel 40 onto which the front lines 202 are, in use, wound and a second or bottom reel 42 on which the back lines 206 are, in use, wound. Both reels 40, 42 are rotatable in two opposite directions about a centre axis 44 of the reeling mechanism 14 in order to allow the front and back lines to be reeled onto and deployed from the reels. It should be understood the kite lines are wound onto the reels 40, 42 by rotating them in a first direction while they are deployed from the reels by rotating the reels in a second direction. In the preferred embodiment of the device 10 the reels 40, 42 are rotated in a clockwise direction to wind the kite lines onto them, i.e. to retract line, and rotated in an anti-clockwise direction to deploy the lines when viewed from above in FIG. 8.

In the illustrated embodiment of the device 10 the front lines 202 and back lines 206 are deployed and retrieved at the same rate by allowing the top reel 40 and bottom reel 42 to rotate in harmony. By rotating the top and bottom reels 40, 42 in harmony the angle of attack of the kite 200 remains constant throughout the launch or retrieval of the kite, thereby allowing accurate control over kite. However, in use after launching the kite 200 it is desired to allow the top reel 40 to rotate independently so as to take up any slack in the front lines 202. More about his is said below.

Figure 9:
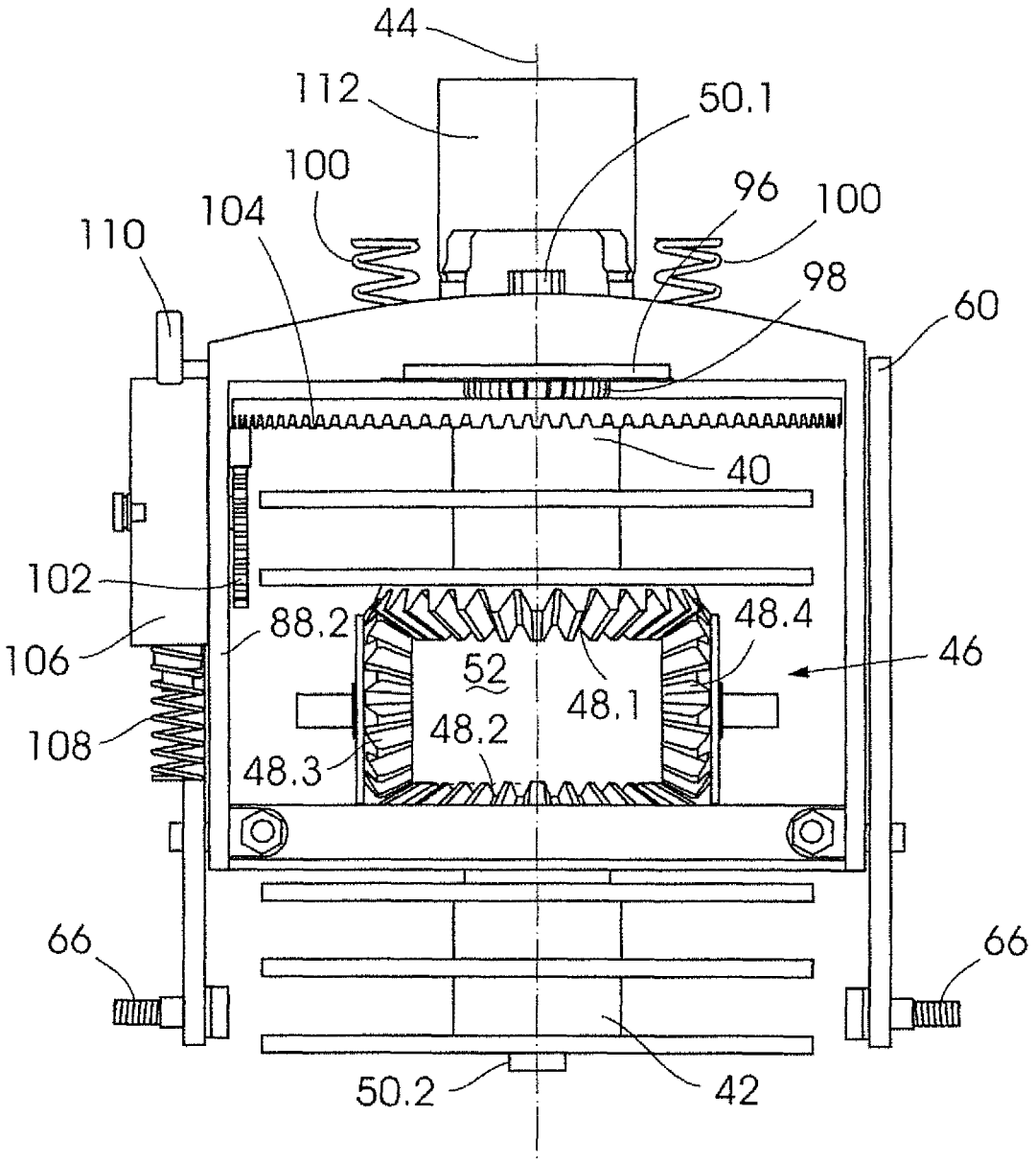
FIG. 9 shows a front view of the device of FIG. 1 in which the enclosure has been removed.

Movement of the top reel 40 and bottom reel 42 is controlled through reel connecting means which is in the form of a gear train 46 in the illustrated embodiment. The gear train 46 is probably best seen in FIG. 9. The gear train 46 has a series of bevel gears which transmits rotation from one reel to the other and, in particular from the bottom reel 42 to the top reel 40. As shown in FIG. 9 the gear train 46 includes a first primary gear 48.1 which has a spindle shaft 50.1 extending from it and a second primary gear 48.2 which as a spindle shaft 50.2 extending from it. The first and second primary gears 48.1, 48.2 are arranged relative to one another so that their shafts 50.1 and 50.2 are axially aligned and extend in opposite directions. To transmit rotation between the two primary gears 48.1 and 48.2 the gear train 46 includes two secondary gears 48.3 and 48.4 which are arranged substantially perpendicularly to the primary gears 48.1 and 48.2. It must be understood that the arrangement of gears in the gear train 46 defines an internal opening or space 52 between them to allow the rope 210 to pass through the reeling device 10 for attachment to the user's harness.

Figure 10:
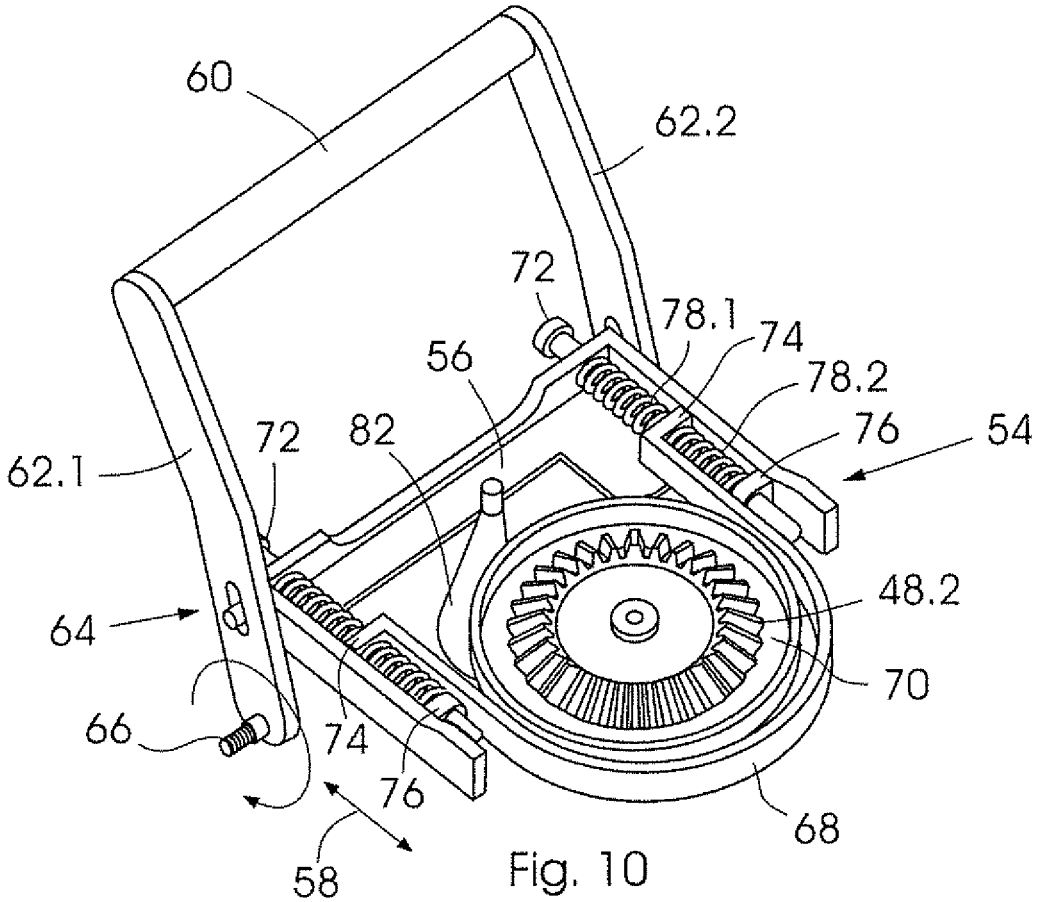
FIG. 10 shows a top perspective view of a braking mechanism of the reeling mechanism of the device of FIG. 1.
Figure 11:
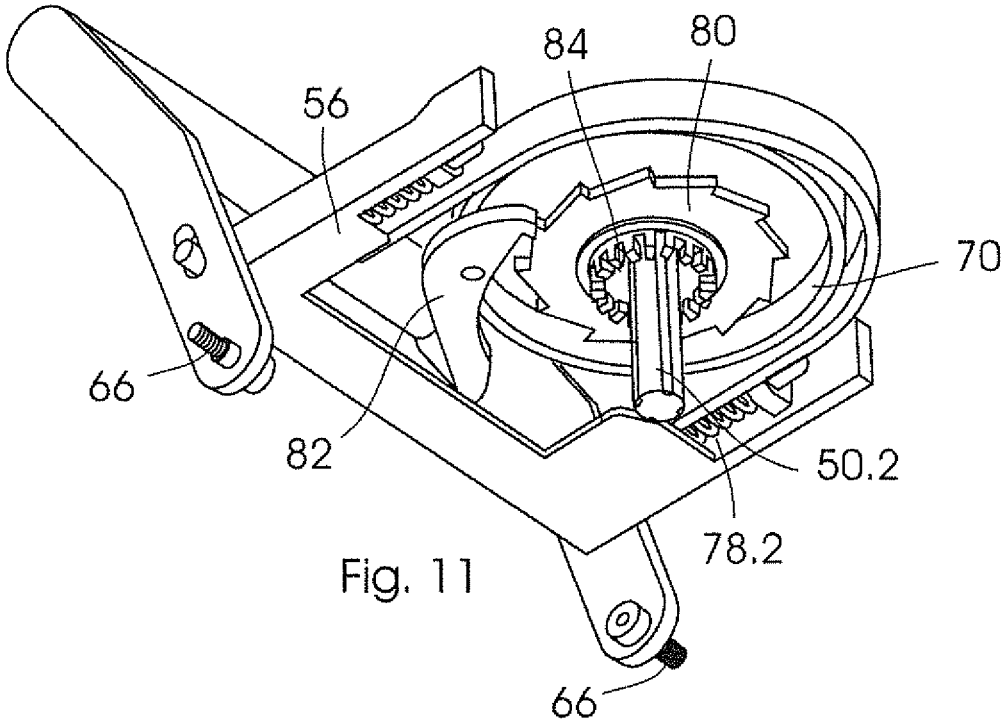
FIG. 11 shows a bottom perspective view of the braking mechanism of FIG. 10.

Rotation of the second primary gear 48.2, and accordingly the bottom reel 42, is controlled by means of a breaking mechanism 54 illustrated in FIGS. 10 and 11, which show a top and bottom perspective view respectively. For the sake of simplicity only the breaking mechanism is shown in these two figures. The braking mechanism 54 has a cam slider 56 which is carried movably on the support block (not shown in FIGS. 10 and 11). The cam slider 56 is movable back and forth in the direction 58 as shown in FIG. 10 through manipulation of a control mechanism in the form of a handle 60. The handle 60 has two legs 62.1 and 62.2 which are each connected to the cam slider 56 through a pin and slot arrangement 64. The ends of the legs 62.1 and 62.2 which are, in use, their bottom ends are fixed to the enclosure of the device 10 and in particular the bottom enclosure 20.2 by means of fasteners 66. The fasteners 66 act as pivot shafts about which the handle 60, in use, pivots when it is moved between its different positions.

Figure 12:
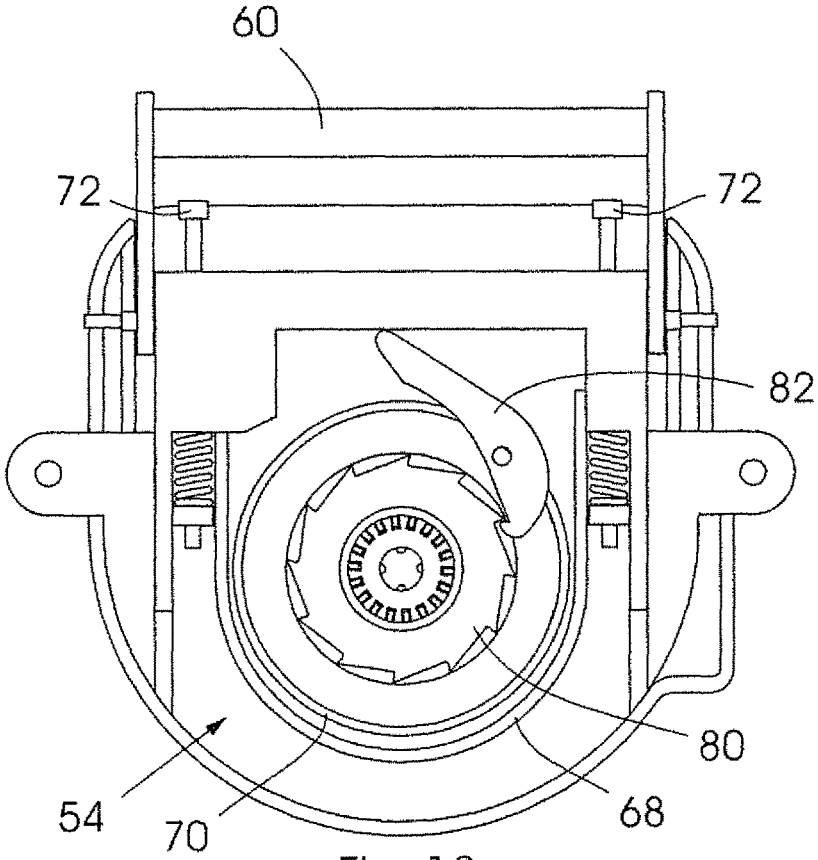
FIG. 12 shows a bottom plan view of the braking mechanism of FIG. 10 in which a ratchet pawl is shown in a locked position engaged with a ratchet.
Figure 13:
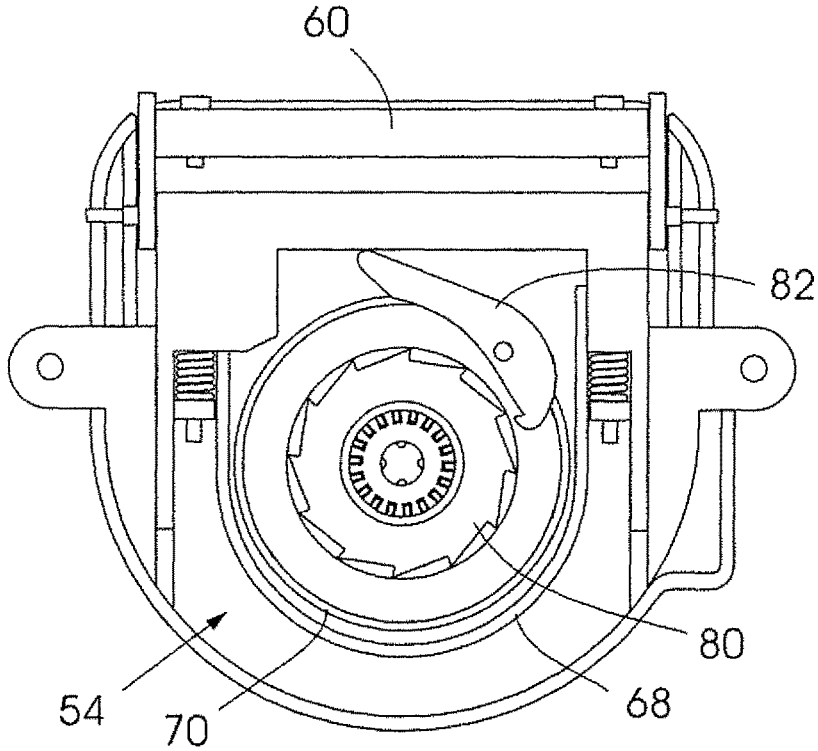
FIG. 13 shows a bottom plan view of the braking mechanism of FIG. 10 in which a ratchet pawl is shown in an unlocked position disengaged from the ratchet.

FIG. 12 shows a top view of the braking mechanism 54 in which the handle 60 is in a first, locked position wherein rotation of the bottom reel 42 is prevented. FIG. 13, in turn, shows a top view of the braking mechanism 54 in which the handle 60 is in a second, released position wherein rotation of the bottom reel 42 is allowed.

When the handle 60 is in its locked position rotation of the bottom reel 42 is prevented by means of a brake shoe 68 acting on a brake drum 70. As can be seen in FIG. 10 the brake shoe 68 is carried on the cam slider 56 while the brake drum 70 is carried on the spindle shaft 50.2 of the second primary gear 48.2. This arrangement allows the brake shoe 68 to be moved relative to the brake drum 70 through manipulation of the handle 60. Referring still to FIG. 10, the brake shoe 68 is connected to the cam slider 56 by means of adjustable pins 72 running through lip formations 74 and 76 located on the brake shoe and cam slider respectively. Front and rear brake springs 78.1 and 78.2 act between the cam slider 56 and brake shoe 68 so that the handle 60 is always moved against spring resistance when it is moved between its locked and released positions.

Referring now in particular to FIG. 11 it can be seen that the brake drum 70 carries a ratchet 80 on a surface which is, in use, a bottom surface. A ratchet pawl 82 is positioned so that it engages the ratchet 80 when the handle 60 is in its locked position and releases the ratchet when the handle is in its released position. These two positions of the ratchet pawl 82 are shown in FIGS. 12 and 13. In the locked position of FIG. 12, in which the ratchet pawl 82 engages the ratchet 80, the bottom reel 42 is prevented from rotating, thereby preventing the device from deploying the kite lines. In contrast, in the position of FIG. 13 in which the ratchet pawl 82 is disengaged from the ratchet 80 the bottom reel 42 is free to rotate to deploy the kite lines. It must be understood that the direction of the ratchet teeth is such that the ratchet obstructs deployment of the kite lines from the reel 42 and not the retrieval of the lines. The ratchet 80 and ratchet pawl 82 are also collectively referred to as movement obstructing means.

To ensure that the ratchet 80 and the bottom reel 42 rotate in harmony the brake drum 70 carries connecting formations which engage complementary shaped connecting formations located on the bottom reel 42. As shown in FIG. 11 the connecting formations on the ratchet 70 are in the form of teeth 84 which engage a series of complementary shaped recesses or sockets (not shown in the accompanying drawings) in the bottom reel. The teeth 84 on the ratchet 80 are permanently engaged with the sockets on bottom reel 42 when the reeling device 10 is assembled.

From the above description of the connection between the bottom reel 42 and the gear train 46 it must be understood that the bottom reel always rotates in harmony with the spindle shaft 50.2 on which it is mounted. This is in contrast to the top reel 40 which is not permanently engaged with the spindle shaft 50.1 of the first primary gear 48.1. Returning now to FIG. 7, it can be seen that the reeling mechanism 14 includes a cam follower bridge 86. The bridge 86 has a central portion 86.1 and two legs 86.2 and 86.3 extending substantially perpendicularly therefrom. Each leg 86.2, 86.3 terminates in a cam follower 88 which, in use, follows a cam profile 90 of the cam slider 56. When the handle 60 is in its locked position as shown in the FIG. 7, the cam followers 88 are located on raised sections or portions 92 of the cam profile 90. When the handle 60 is moved into its release position, the cam followers 88 move downwardly onto a lower section or portion 94 of the cam slider 56 so that the entire cam follower bridge 86 is lowered. This downward movement of the bridge 86 forces a dog plate 96 downwardly towards the top reel 40 so as to engage complementary shaped connecting formations carried on the dog plate and top reel respectively. The complementary shaped connecting formations are again in the form of a series of teeth 98 (FIG. 9) located on the dog plate 96 which engage recesses or sockets (not visible in the accompanying drawings) in the top reel 40. It should be clear that when the teeth 98 engage the sockets in the top reel 40 rotation of the dog plate 96 can be transferred to the top reel 40.

To ensure that the bridge 86 follows the cam profile 88 of the cam slider 56, two compression springs 100 are located and act between the central portion 86.1 of the bridge and the top enclosure 20.1. From FIG. 7 it can be seen that the springs 100 are arranged so that their centre axes are substantially in line with the centre axis 44 of the reeling mechanism 14. The springs 100 are of such a length that they are compressed when the reeling device 10 is assembled, i.e. when the top enclosure 20.1 is connected to the bottom enclosure 20.2. This arrangement provides that the bridge 86 is, in use, forced downwardly under spring bias, thereby automatically engaging the dog plate 96 with the top reel 40 when the handle 60 is moved from its locked position into its released position. The internal passage of the dog plate through which the spindle shaft 50.1 extends is complementary shaped to the spindle shaft so that the dog plate always moves in harmony with the spindle shaft 50.1 and therefore the first primary gear 48.1. It should therefore be understood that when the handle 60 is in its release position the dog plate 96 engages the top reel 40 so that the top and bottom reels 40, 42 rotate in harmony. In this configuration in which the top and bottom reels 40, 42 rotate in harmony it is said that the gear train 46 is engaged or connected. Conversely, in the other configuration in which the reels 40, 42 do not rotate in harmony it is said that the gear train is disengaged or disconnected.

The reeling mechanism 14 also includes a retraction system having a spring biased gear 102 (FIG. 9) mounted on the bridge leg 88.2 for engagement with gear teeth 104 carried by the top reel 40. The spring biased gear 102 is also referred to as the spring retractor gear 102. The retractor gear 102 has a shaft protruding perpendicularly from it and which extends into a housing 106 where a torsion spring (now shown) is located. The shaft of the retractor gear 102 extends through an elongate slot in the bridge leg 88.2 in such a manner that the shaft is allowed to move back and forth along the length of the slot, i.e. up and down in the orientation of FIG. 9. From FIG. 9 it can be seen that the housing 106 is urged by a coil spring 108 in a direction which is, in use, substantially an upward direction. It should be clear that the retractor gear 102 is urged upwardly into a position wherein it engages the teeth 104 carried by the top reel 40. When engaging the top reel 40, the torsion spring acting on the shaft of the retractor gear 102 biases it into a direction in which slack is taken up in the front lines. In view of the fact that the retractor gear 102 remains substantially stationary, apart from the minimal rotation to take up slack in the front lines 202, it obstructs rotation of the top reel 40 when it engages the teeth 104 of the top reel 40. In order to allow rotation of the top reel 40 the retractor gear 102 has to be disengaged, i.e. moved downwardly away from the top reel 40, by either pressing the housing 106 manually downwardly or by moving the handle 60 into its release position which lowers the bridge 86 and accordingly the spring retractor gear 102 mounted thereon.

During the launch of the kite the handle 60 will be pulled back into its release position which disengages the retractor gear 102 to allow both the reels 40 and 42 to deploy line. After the desired amount of line has been deployed from the reels the handle 60 is moved back into its locked position which engages the retractor gear 102 in order to prevent rotation of the top reel 40. In the event that there is excess or slack line on the front lines this is taken up by the torsion spring located in the retractor housing 106. It should be understood that prior to launching the kite 200 the front and back lines 202, 206 are preferably adjusted so that they are of equal length. This is done by manually pressing down on the housing 106 to allow the top reel 40 to rotate independently from the bottom reel 42. In this position the top reel 40 can deploy additional line independently from the bottom reel 42 should this be desired. A raised button 110 extends from the housing 106 and protrudes through an opening in the top enclosure 20.1 so that it is accessible to the user. The retractor gear 102 can therefore be disengaged from the top reel 40 by depressing the button 110.

It is envisaged that alternative retraction systems could be used in alternative embodiments of the reeling device. For example, the coil spring 108 could be built into the centre of the top reel 40.

It is also envisaged that the retraction system could be removed completely from the device 10. This would result in a significant reduction in weight, size and complexity of the device 10. If the retraction system is removed from the device it would not have the ability to take up slack in the front lines after the launch of the kite. It is believed that this would not have a significant effect on the operation and effectiveness of the reeling device 10. It is further envisaged that this alternative embodiment, in which the slack in the front lines is not retracted, could include a guard for the front lines to protect them in use.

Figure 14:
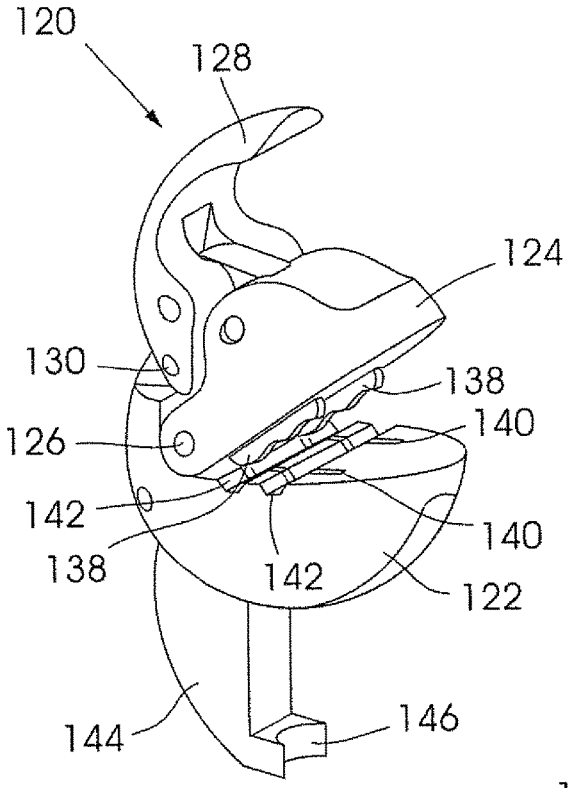
FIG. 14 shows a perspective view of a line locking mechanism of the device of FIG. 1, the locking mechanism being shown in its open configuration.
Figure 15:
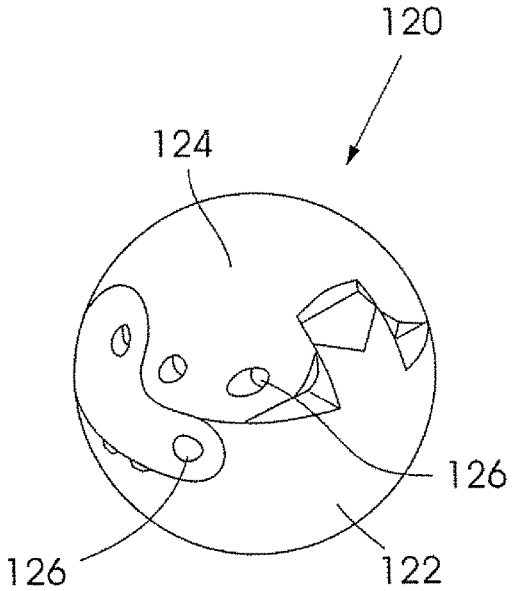
FIG. 15 shows a perspective view of the line locking mechanism of FIG. 14 in its closed configuration.

As mentioned above, after deployment of the lines and before retrieving any slack in the front lines 202, the line locking mechanism 120 has to be attached to the front lines. The line locking mechanism 120 is shown in detail in FIGS. 14 to 16. FIG. 14 shows the mechanism 120 in an open, unlocked position wherein the kite lines 202 can be placed into or taken out of its jaws while FIG. 15 shows the locking mechanism in a closed, locked position wherein the lines can be locked in its jaws. Referring in particular to FIG. 14 it can be seen that the mechanism is designed as a clamp which has a clamp body 122 and a movable top clamp 124. The top claim 124 is movably secured to the clamp body 122 by means of a pin 126. To pivot the top clamp 124 about the pin 126 a clamp lever 128 is provided. The clamp lever 128 is connected to both the clamp body 122 by means of a pin 130 and the top clamp 124 by means of a linkage 132. Probably best seen in FIG. 16, the linkage 132 is also connected to the clamp lever 128 and top clamp 124 by means of pins 134 and 136. The linkage 132 forces the top clamp 124 into its closed position as the lever 128 is moved into its closed position. In the closed position the linkage locks or holds the top clamp 124 in its closed position so as to secure the front lines in the line locking mechanism 120. The clamp body 122 and top clamp 124 carry complementary shaped gripping formations for gripping the kite lines 202 when the line locking mechanism is in its closed position. As shown in FIG. 14 the gripping formations on the top clamp 124 are in the form of teeth 138 and the gripping formations on the clamp body 122 are in the form of recesses 140 in which the teeth are received when the clamp body is closed. The recesses 140 run transverse to grooves 142 in which the kite lines are received when the line locking mechanism 120 is attached to them. The teeth 138 are profiled so as to help capture the kite lines as the top clamp 124 is moved into its closed position. It should be understood that the teeth 138 help secure the line locking mechanism 120 on the kite lines by deforming the lines, thereby increasing the gripping force being exerted on the kite lines. In the illustrated embodiment of the mechanism 120 the teeth 138 introduce a kink in the lines 202.

Figure 16:
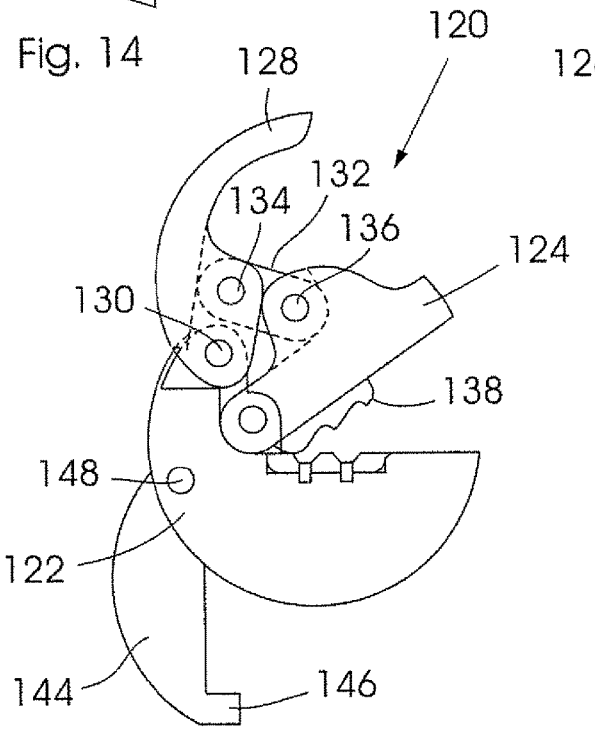
FIG. 16 shows a side view of the line locking mechanism of FIG. 14 in its open configuration.

Probably best seen in FIG. 16, the gripping tool 144 is movable between an operative position (as shown in FIG. 16) and an inoperative position wherein it is stowed away inside the clamp body 122. The gripping tool 144 pivots about a pin 148 between its operative and inoperative positions. It is envisaged that the gripping tool 144 will remain in its inoperative position and will only be moved into its operative position when the user wants to move the handle bars 12.1 and 12.2 between their extended or collapsed positions.

Figure 4:
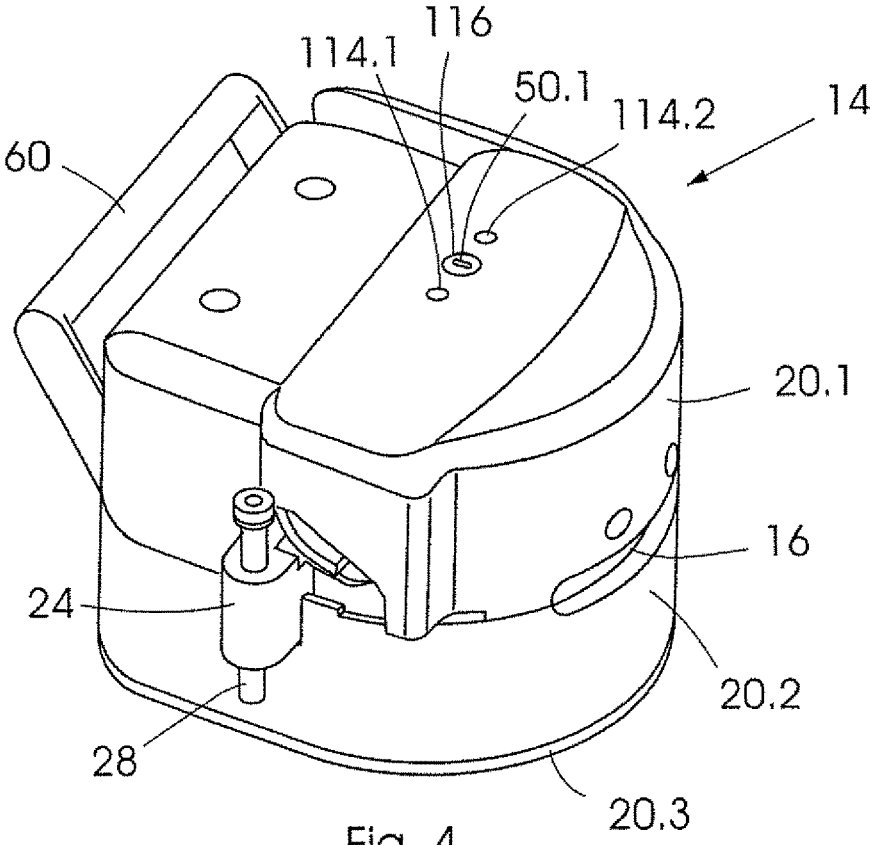
FIG. 4 shows perspective view of the device of FIG. 1 in which the handle bars have been removed.

From the above description of the kite reeling mechanism 14 it should be understood that in order to retrieve the kite lines the gear train 46 has to be connected, i.e. the dog plate 96 has to be engaged with the top reel 40 so that the top and bottom reels 40, 42 rotate in harmony. Instead of using the handle 60 to do this an adaptor 112 is inserted into openings 114.1 and 114.2 in the top enclosure 20.1. The adaptor 112 extends through the openings 114.1 and 114.2 and engages the dog plate 96 so that downward movement of the adaptor forces the dog plate 96 downwardly. The adaptor 112 also allows for the alignment of an external hand operated tool, such as a drill for example, with the spindle shaft 50.1. As shown in FIG. 4 the end of the spindle shaft 50.1 carries a tool engagement hole 116 for engagement with the hand operated drill. When retrieving the kite 200 the adaptor 112 for the drill is attached to the drill tip for easy one hand operation. The adaptor is placed in position, i.e. in the holes 114.1 and 114.2, and the hand operated drill, carrying a flat bit, is inserted into the adaptor until the bit engages the hole 116 in the spindle shaft 50.1. The hand operated drill is then pressed downwardly to force the dog plate 96 to engage the top reel 40, thereby connecting the gear train 46. The hand tool is then actuated to rotate the spindle shaft 50.1 and accordingly the top and bottom reels 40 and 42 in an anticlockwise direction to retrieve the kite lines. Once the kite lines have been retrieved by a satisfactory amount the adaptor 112 and hand operated drill are simply removed.

It should be noted that before the lines are retrieved by means of the hand operated drill as described above the line locking mechanism 120 has to be removed from the front lines 202.

It is believed that various modifications could be made to the reeling device 10 without departing from the spirit and scope of the invention. For example, the positions of the reels 40 and 42 could be changed. It is envisaged that instead of positioning the reels 40, 42 on opposite sides of the handlebar, they could be stacked directly on top of each other and laid flat then placed on top of or below the handlebar. There is also provided for the reels 40, 42 to be oriented vertically, i.e. so that their axial centrelines are substantially parallel to the handlebar, then placed on top or below the handlebar.

It is also envisaged that the reeling device 10 could include an additional braking/locking mechanism to ensure the top reel does not over-deploy. In the embodiment illustrated in the accompanying drawings, when the handle 60 is released and the top reel 40 is disengaged from the bottom reel 42, the front line retraction system requires a bit of time to engage. This means that there is a short duration where the top reel 40 is allowed to freewheel if winds speeds are high. The additional braking/locking mechanism will be designed to prevent freewheeling of the top reel 40.

It is further envisaged that the device could also include additional line locks to prevent slippage of the lines. The line locks could be located at the ends of the handlebar and at the exit point in the enclosure for the front lines.

It is also envisaged that the device 10 could include a safety line for use in the event that the chicken loop 211 is pulled. The safety line will typically be connected to one of the front lines 202 using a line locking mechanism similar to the line locking mechanism 120 from where it will run along the strap 214 and the rope 210 towards the harness worn by the user, in use. The safety line will generally be connected to the harness so that the front line to which it is connected remains in connection with the user's harness when the chicken loop is pulled. It is envisaged that the line locking mechanism connecting the safety line to the front line will be located in a position between the connector 212 and the kite 200. It is envisaged that the safety line could either run along the rope 210 or inside the rope 210, i.e. be integrated with the rope. In both option it should be understood that the safety line would run through the opening 16 in the enclosure of the device.

Having described the structure of the kite line reeling device 10 in detail the method of operating it will now be described in more detail. The line reeling device 10 may be operated to launch and retrieve the kite 200 and both processes will be described.

The process of launching the kite 200 will be described first. It should be clear that prior to launching the kite 200 the front and rear kite lines 202, 206 are wound on the reels such that only their ends protrude from the device for attachment to the kite. It is envisaged that when transporting the kite 200 to the location where it will be launched the handle bars 12.1 and 12.2 will be in their collapsed positions in which they hold the kite securely between them. At the location where the kite is to be launched the handle bars 12.1 and 12.2 are moved into their operative positions in order to release the kite 200. The handle bars 12.1 and 12.2 are automatically locked in their operative positions by means of the securing pins 36 as mentioned above. Now that the kite 200 is released from the handle bars 12.1 and 12.2 it is typically inflated and then connected to the front and back lines 202, 206. It should be noted that it may not be necessary to connect the kite to the front and back lines as they may already be connected. It is possible to keep the kite connected to the front and back lines. More about this is said below. With the kite inflated and connected to the line reeling device 10 it will be flying around the 12 o'clock position in the wind where it can easily be controlled by the user. A person skilled in the art of kite surfing will know that in this 12 o'clock position there is a minimum amount of tension in the kite lines. It may be necessary to adjust the length of the front lines 202 so that the front and back lines are of equal length. This is done by pressing down on the button 110 so as to disengage the spring retractor gear 102 from the top reel 40, thereby allowing the top reel 40 to rotate. With the kite in the 12 o'clock position the user releases one hand from its handlebar 12.1, 12.2 and grips the handle 60 of the kite reeling device 10. The handle is then pulled back, i.e. towards the user, in order to start releasing line from the top and bottom reels 40 and 42. From the above description it should be understood that by pulling the handle 60 backwards the cam slider 56 also moves backwards to lower the cam follower bridge 86 and thereby engage the dog plate 96 with the top reel 40. By engaging the dog plate 96 with the top reel 42 the gear train 46 is connected to allow the top and bottom reels 40, 42 to rotate in harmony and dispense line at the same rate. However, to allow the reels 40, 42 to rotate the spring retractor gear 102 is also moved downwardly in order to disengage the top reel 40 through movement of the cam follower bridge 86. At the same time, the cam slider 56 actuates the ratchet pawl 82 to move it into its disengaged position in which the brake drum 70 is released, i.e. free to rotate. The cam slider 56 also moves the brake shoe 68 away from the brake drum 70 in order to reduce the braking force acting on the drum, thereby allowing the reels 40, 42 to rotate. It should be understood that the degree of backwards movement of the cam slider 56 is inversely proportional to the braking force being applied to the brake drum. In other words, the more the handle 60 is pulled back, the lower the braking force being applied to the brake drum 70. It is envisaged that this could be an important safety feature seeing that the user can accurately control the rate at which the lines 202, 206 are being deployed by manipulating the movement of the handle 60. During a typical launch of the kite 200 the handle 60 will be pulled back gradually so as to increase the rate at which the lines are deployed from the reels 40, 42 gradually. As the lines reach their desired length the rate at which the lines are being deployed is typically reduced by moving the handle 60 forwards in a controlled manner. This feature of the line reeling device 10 allows for very accurate control of the length of the kite lines that are deployed during the launch of the kite 200. It is envisaged that at least the front lines 202 could carry indicators to indicate to the user exactly how much line has been deployed from the reels. In one embodiment the front lines could change colour at regular intervals, e.g. every 10 cm for last 2 m, to act as a cue to the user while launching the kite 200. The user can then reduce the rate at which the lines are being deployed when spotting the indicators.

As soon as the desired amount of line has been deployed from the reels 40, 42 the user releases the handle 60 so that it returns to its inoperative position. By releasing the handle 60 the cam slider 56 moves back into its original position, thereby activating the braking mechanism and engaging the ratchet pawl 82 with the ratchet 80 on the brake drum 70. The movement of the cam slider 56 into its original position also moves the cam follower bridge 86 back into its original, raised position in order to disengage the dog plate 96 from the top reel 40. In other words, the disengagement of the dog plate 96 and top reel 40 disconnects the gear train 46 to allow the top reel to rotate independently from the bottom reel. The movement of the cam follower bridge 86 into its original, raised position engages the spring retractor gear 102 with the top reel 40 so that rotation of the top reel is prevented. Now that the top reel 40 is disengaged from the bottom reel 42, it can be manipulated to dispense additional line or retract slack in the front lines. The torsion spring in the housing 106 operates on the retractor gear 102 to retract any slack line in the front lines. Addition line could be deployed from the top reel 40 by pressing down on the button 110 carried by the spring retractor gear housing 106. After the adjustment to the front lines is made the button 110 is released in order to engage the spring retractor gear 102 with the teeth 104 on the top reel 40 so as to lock the top reel in position.

However, prior to adjusting the length of the front lines 202, the line locking mechanism 120 is connected to them. This is done by moving the mechanism 120 into its open, unlocked position and placing the front lines in its jaws. Next, the clamp lever 128 is operated so as to close the jaws in order to lock the locking mechanism on the front lines. As mentioned above, now that the line locking mechanism 120 is fixed on the front lines it engages the connector 212 so that force is transmitted through the rope 210 that is attached to the user's harness. The section of the front lines after the line locking mechanism 120, i.e. the section of the front lines at the user's side of the locking mechanism, carries no tension and any slack in the front lines are taken up by the torsion spring located in the housing 106.

To retrieve the kite after a kite surfing session the user removes one hand from its handle bar 12.1, 12.2 and inserts the adaptor 112 into the openings 114.1 and 114.2 in the top enclosure 20.1 so that it engages the dog plate 96. The hand operated drill is inserted into the adaptor 112 to engage the tool engagement hole 116 at the end of the spindle shaft 50.1. The hand operated drill is then pressed downwardly to force the dog plate 96 to engage the top reel 40, thereby connecting the gear train 46. The hand drill is now activated to rotate the spindle shaft 50.1 and accordingly the top and bottom reels 40, 42 in an anticlockwise direction to retrieve the kite lines 202, 206. Once the kite lines have been retrieved by a satisfactory amount the adaptor 112 and hand operated drill are simply removed. The kite 200 is then disconnected from the kite reeling device 10, deflated and folded-up. Alternatively, the kite 200 may remain connected to the kite lines 202, 206 and accordingly the reeling device 10. Irrespective of whether or not the kite 200 remains connected to the kite lines 202, 206 on the reels 40, 42, it may again be placed and held securely between the handle bars 12.1 and 12.2 when they are in their collapsed positions.

Although the device 10 is described and illustrated to be integrally formed with the handle bar of the kite it is envisaged that in an alternative embodiment not illustrated in the drawings the line reeling mechanism 14 could also be retrofitted to an existing handle bar of a kite after making the necessary minor changes without departing from the spirit and scope of the invention. For example, the enclosure could be removably attachable to an existing handle bar and the back lines 206 could run in conduits carried by the handle bar.

From the above description it must be clear that one advantage of the device 10 in accordance with the invention is that it allows the kite 200 to be launched and landed anywhere. As it is no longer required to lay out the front and back lines prior to launching the kite it can be launched even where space is limited, such as off boats for example. Another advantage of the device 10 is that it makes the launching and landing of a kite a lot safer to the user and bystanders. The device 10 allows the kite to be launched and landed in a controlled manner by using the handle and hand held drill respectively. It is no longer required to launch and land the kite at the edge of the wind as the line reeling device 10 allows the kite to be launched and landed while maintaining it at the twelve o'clock position in the wind. It should however be understood that the device 10 not only allows the kite 200 to be launched in the twelve o'clock position but in any position in the 180° wind arch or dome. This allows the kite 200 to be launched in positions in which it would otherwise not have been possible due to overhead obstacles.

Yet another advantage of the device 10 is that it speeds up the launching and landing process as it is no longer required to lay out the lines and wrap them around the handle bar manually. With the use of the device 10 the front and back lines are reeled in automatically onto the reels 40 and 42, which also reduces the risk of getting them tangled up. It is also no longer required to disconnect the kite from the kite lines 202, 206 as it could remain connected to the lines at all times.

It is also believed that the line reeling device 10 could be used to adjust the length of the lines to accommodate different kite sizes and environmental conditions. The user can therefore adjust the lines according to his/her needs and do not need to fly a kite at the maximum length of the lines at all times as in the case of known, prior art equipment.

The invention claimed is:

1. A line reeling device for reeling front lines of a kite, in use, connected to a leading edge portion of the kite and back lines of the kite, in use, connected to a trailing edge portion of the kite, the device including:

a reeling mechanism comprising:

a first reel on which the front lines are, in use, wound and being arranged so that rotation of the first reel in one direction retracts the front lines and rotation of the first reel in the other direction deploys the front lines;

a second reel on which the back lines are, in use, wound and being arranged so that rotation of the second reel in one direction retracts the back lines and rotation of the second reel in the other direction deploys the back lines; and the first and second reels being located in an enclosure;

a reel connecting means which is operable to cause the first and second reels to rotate in harmony in one configuration to keep the angle of attack of the kite constant to allow for accurate control over the kite and rotate independently in another configuration to allow for a change in the angle of attack of the kite in order to power and depower the kite;

a braking mechanism for controlling rotation of the reels; and a control mechanism which is operable between a first, locked position and a second, released position;

wherein movement of the control mechanism between its locked and released positions controls the reel connecting means between its different configurations and controls the breaking mechanism to adjust the braking force.

2. A line reeling device according to claim 1, wherein the reeling mechanism includes a movable cam slider and a cam follower which runs on the cam slider and is moveable substantially perpendicularly to the cam slider in response to movement of the cam slider, and wherein the cam slider is connected to the control mechanism such that it is moveable through manipulation of the control mechanism between its locked and released positions.

3. A line reeling device according to claim 2, wherein the braking mechanism includes a brake drum and brake shoe carried by the cam slider so that the brake shoe is movable towards and away from the brake drum through movement of the control mechanism between its locked and released positions respectively, thereby allowing the magnitude of braking force to be adjusted by moving the control mechanism.

4. A line reeling device according to claim 3, wherein the reeling mechanism includes movement obstructing means for obstructing rotation of at least the second reel in a direction in which the back lines are deployed from the reel, the movement obstructing means being operable between its movement obstructing position and its movement allowing position through manipulation of the control mechanism.

5. A line reeling device according to claim 2, wherein the reeling mechanism includes a retraction system acting on the first reel, the retraction system preventing rotation of the first reel in a first configuration and allows rotation of the first reel in a second configuration, and wherein the braking mechanism acts on the second reel to control rotation of the second reel.

6. A line reeling device according to claim 1, including two handle bars which are movablely connected to the enclosure such that they are movable between a first, operative position wherein they extend from the enclosure in substantially opposite directions and a second, inoperative position wherein they run substantially parallel to one another.

7. A line reeling device according to claim 1, including a line locking mechanism which is releasably securable to the front lines of the kite so as to allow a force to be transmitted from the front lines to the harness worn by the user, in use.

8. A kit including a line reeling device according to claim 1 and a hand operated tool which is engageable with the line reeling device so as to rotate the reels to retrieve the kite lines when the hand operated tool is activated.

9. A method of operating a kite using a line reeling device, the method including the following steps:

providing a reeling mechanism comprising:

a first reel on which front lines are, in use, wound and being arranged so that rotation of the first reel in one direction retracts the front lines and rotation of the first reel in the other direction deploys the front lines;

a second reel on which back lines are, in use, wound and being arranged so that rotation of the second reel in one direction retracts the back lines and rotation of the second reel in the other direction deploys the back lines; and the first and second reels being located in an enclosure;

connecting the front lines to a leading edge portion of the kite and connecting the back lines to a trailing edge portion of the kite;

operating a control mechanism from a first, locked position into a second, released position, thereby engaging reel connecting means to cause the first and second reels to move in harmony and releasing a braking mechanism to allow the first and second reels to rotate and thereby deploy line from the reels at the same rate to keep the angle of attack of the kite constant to allow for accurate control over the kite; and operating the control mechanism from the second, released position into the first, locked position, thereby braking the reels by applying the braking mechanism, disengaging the reel connecting means to allow the first and second reels to rotate independently from one another to allow for a change in the angle of attack of the kite in order to power and depower the kite and locking the first reels to prevent it from rotating in a direction deploying line, in use, while flying the kite.

10. A method according to claim 9, including the step of connecting a line locking mechanism on the front lines to engage a connector carried on the front lines, thereby to transfer tension from the front lines to a harness warn by the user.

11. A method according to claim 9, including the step of controlling the rate at which the lines are being deployed by adjusting the braking force being applied by the braking mechanism.

12. A method according to claim 9, wherein the step of releasing a braking mechanism includes moving a brake shoe away from a brake drum.

13. A method according to claim 9, wherein the step of preventing the reels from rotating in a direction deploying line includes preventing them independently from rotating in a direction deploying line.

14. A method according to claim 9, including the step of retrieving the kite lines by engaging a hand operated tool with the line reeling device and activating the tool to rotate the reels in a direction opposite to the direction in which they rotate to deploy line.

15. A method according to claim 9, including moving handle bars protruding from the line reeling device between operative and inoperative positions.

* * * * *